US009440786B2

(12) United States Patent
Giesbers et al.

(10) Patent No.: US 9,440,786 B2
(45) Date of Patent: Sep. 13, 2016

(54) COLLAPSIBLE FREIGHT CONTAINER

(75) Inventors: Rene Giesbers, Ridderkerk (NL); Bram Jeroen Bruinsma, Hilversum (NL)

(73) Assignee: Cargoshell Holding B.V., Rotterdam (NL)

( * ) Notice: Subject to any disclaimer, the term of this patent is extended or adjusted under 35 U.S.C. 154(b) by 570 days.

(21) Appl. No.: 13/822,233

(22) PCT Filed: Aug. 30, 2011

(86) PCT No.: PCT/NL2011/050589

§ 371 (c)(1),
(2), (4) Date: May 17, 2013

(87) PCT Pub. No.: WO2012/036544

PCT Pub. Date: Mar. 22, 2012

(65) Prior Publication Data

US 2014/0144907 A1 May 29, 2014

(30) Foreign Application Priority Data

Sep. 13, 2010 (NL) ..... 2005344

(51) Int. Cl.

| | |
|---|---|
| ***B65D 88/00*** | (2006.01) |
| ***B65D 88/52*** | (2006.01) |
| ***B65D 90/00*** | (2006.01) |
| ***B65D 88/12*** | (2006.01) |

(52) U.S. Cl.

CPC ..... *B65D 88/524* (2013.01); *B65D 88/12* (2013.01); *B65D 90/0086* (2013.01)

(58) Field of Classification Search

CPC B65D 90/008; B65D 90/0086; B65D 88/00; B65D 88/02; B65D 88/12; B65D 88/121; B65D 88/52; B65D 88/522; B65D 88/524; E05B 83/02; E05B 83/08

USPC ..... 220/1.5, 4.33, 6, 7, 666

See application file for complete search history.

(56) References Cited

U.S. PATENT DOCUMENTS

| | | | | | |
|---|---|---|---|---|---|
| 578,445 | A | * | 3/1897 | Cobleigh | 217/14 |
| 702,237 | A | * | 6/1902 | McCullough | 217/15 |
| 989,074 | A | * | 4/1911 | Stall | 217/15 |
| 1,114,860 | A | * | 10/1914 | Colombot | 217/15 |
| 1,496,965 | A | * | 6/1924 | Aldeen | 217/60 G |
| 1,673,769 | A | * | 6/1928 | Graham | 220/6 |
| 2,224,310 | A | * | 12/1940 | Merrett et al. | 5/99.1 |
| 2,439,132 | A | * | 4/1948 | Hatala et al. | 220/88.1 |
| 2,520,921 | A | * | 9/1950 | Foster | 16/401 |
| 2,803,084 | A | * | 8/1957 | Frerking | 43/55 |
| 2,912,237 | A | * | 11/1959 | Snyder | 49/199 |
| 3,451,718 | A | * | 6/1969 | Kaufman | 297/239 |
| 3,527,339 | A | * | 9/1970 | Cipolla | 206/290 |
| 3,570,698 | A | * | 3/1971 | Dougherty | 220/1.5 |
| 3,602,388 | A | * | 8/1971 | Hurkamp | 220/1.5 |
| 3,865,269 | A | * | 2/1975 | Coleman | 220/6 |
| 4,074,766 | A | * | 2/1978 | Orthman | 172/311 |

(Continued)

FOREIGN PATENT DOCUMENTS

| | | | | |
|---|---|---|---|---|
| GB | 1007196 | | 10/1965 | |
| JP | 2002264993 | A * | 9/2002 | B65D 88/52 |

(Continued)

*Primary Examiner* — Steven A. Reynolds
*Assistant Examiner* — Javier A Pagan
(74) *Attorney, Agent, or Firm* — Casimir Jones, SC

(57) ABSTRACT

The invention relates to a collapsible freight container and related methods thereof.

11 Claims, 8 Drawing Sheets

(56) References Cited

U.S. PATENT DOCUMENTS

| | | | | | |
|---|---|---|---|---|---|
| 4,099,640 | A * | 7/1978 | Nessfield et al. | 220/6 |
| 4,177,907 | A * | 12/1979 | Funaioli et al. | 220/1.5 |
| 4,214,669 | A * | 7/1980 | McQuiston | 220/6 |
| 4,382,312 | A * | 5/1983 | Liggett et al. | 16/365 |
| 4,400,994 | A * | 8/1983 | Skjaeveland | 74/520 |
| 4,512,416 | A * | 4/1985 | Smith | 172/776 |
| 4,527,303 | A * | 7/1985 | Civitelli | 16/86 B |
| 4,577,772 | A * | 3/1986 | Bigliardi | 220/1.5 |
| 4,630,746 | A * | 12/1986 | Fortenberry | 220/6 |
| 4,775,066 | A * | 10/1988 | Keppeler | 220/484 |
| 4,827,569 | A * | 5/1989 | Mertes | 16/288 |
| 4,848,618 | A * | 7/1989 | Yuan et al. | 220/1.5 |
| 4,913,301 | A * | 4/1990 | Pickler | 414/403 |
| 4,913,302 | A * | 4/1990 | Stonier | 220/6 |
| 5,064,068 | A * | 11/1991 | Sheng | 206/425 |
| 5,289,933 | A * | 3/1994 | Streich et al. | 220/1.5 |
| 5,538,320 | A * | 7/1996 | Hoffman et al. | 297/188.1 |
| 5,584,530 | A * | 12/1996 | Rogers et al. | 297/188.1 |
| 5,904,262 | A * | 5/1999 | Coppi | 220/7 |
| 6,308,376 | B1 * | 10/2001 | Koshikawa | 16/250 |
| 6,345,679 | B1 * | 2/2002 | Sasaki | 180/274 |
| 6,382,327 | B1 * | 5/2002 | Mosdal | 172/311 |
| 6,499,189 | B2 * | 12/2002 | Kondo et al. | 16/289 |
| 6,527,341 | B1 * | 3/2003 | Martin | 297/332 |
| 6,929,321 | B1 * | 8/2005 | Shrock | 297/118 |
| 7,083,061 | B2 * | 8/2006 | Spindel et al. | 220/6 |
| 7,100,241 | B2 * | 9/2006 | Zetti | 16/304 |
| 7,197,790 | B1 * | 4/2007 | Edmondson | 16/336 |
| 7,418,766 | B2 * | 9/2008 | Nelson et al. | 16/239 |
| 7,574,775 | B2 * | 8/2009 | Zetti | 16/370 |
| 7,681,945 | B1 * | 3/2010 | Wiecek et al. | 297/118 |
| 7,698,785 | B2 * | 4/2010 | Bennett | 16/369 |
| 7,722,101 | B2 * | 5/2010 | Bellehumeur et al. | 294/81.53 |
| 7,823,739 | B2 * | 11/2010 | Sadkin et al. | 220/6 |
| 7,870,970 | B2 * | 1/2011 | Fisk | 220/7 |
| 7,886,407 | B2 * | 2/2011 | Resnik et al. | 16/286 |
| 8,011,523 | B2 * | 9/2011 | Kochanowski | 220/1.5 |
| 8,113,372 | B2 * | 2/2012 | Bellehumeur et al. | 220/7 |
| 8,251,237 | B2 * | 8/2012 | Beaudonnet | 220/4.28 |
| 2004/0177476 | A1 * | 9/2004 | Zetti | 16/287 |
| 2006/0130277 | A1 * | 6/2006 | Nelson et al. | 16/327 |
| 2007/0006420 | A1 * | 1/2007 | Zetti | 16/287 |
| 2008/0000900 | A1 * | 1/2008 | Beaudonnet | 220/4.28 |
| 2008/0011742 | A1 * | 1/2008 | Bellehumeur et al. | 220/1.5 |
| 2008/0029510 | A1 * | 2/2008 | Fisk | 220/7 |
| 2008/0135545 | A1 * | 6/2008 | Sadkin et al. | 220/1.5 |
| 2010/0024162 | A1 * | 2/2010 | Walz | 16/233 |
| 2010/0102056 | A1 * | 4/2010 | Bellehumeur et al. | 220/6 |
| 2010/0133264 | A1 * | 6/2010 | Chawla et al. | 220/1.5 |
| 2010/0292063 | A1 * | 11/2010 | Chawla et al. | 493/409 |
| 2012/0138604 | A1 * | 6/2012 | Bellehumeur et al. | 220/1.5 |
| 2012/0248105 | A1 * | 10/2012 | Leong | 220/7 |

FOREIGN PATENT DOCUMENTS

| | | |
|---|---|---|
| WO | 2006/024104 | 3/2006 |
| WO | 2007/081556 | 7/2007 |
| WO | 2010/075607 | 7/2010 |
| WO | 2010/085785 | 7/2010 |

* cited by examiner

COLLAPSIBLE FREIGHT CONTAINER

CROSS-REFERENCE TO RELATED APPLICATIONS

The present application is a U.S. National Phase Entry of pending International Patent Application No. PCT/NL2011/050589, international filing date Aug. 30, 2011, which claims priority to Dutch Patent Application No. NL2005344, filed Sep. 13, 2010, the contents of which are incorporated by reference in their entireties.

FIELD OF THE INVENTION

The invention relates to a collapsible freight container comprising a bottom, a roof, two end walls extending between the bottom and the roof, as well as two longitudinal side walls connected to said bottom and said roof, each longitudinal side wall comprising an upper part, a central part and a lower part, which parts are hinged together and to the bottom by means of hinge mechanisms for folding the container from an unfolded position to a collapsed position and conversely, said roof and said upper part being immovably fixed relative to each other, defining a space in which the end walls are present in the collapsed position.

INTRODUCTION

The invention relates to a collapsible freight container comprising a bottom, a roof, two end walls extending between the bottom and the roof, as well as two longitudinal side walls connected to said bottom and said roof, each longitudinal side wall comprising an upper part, a central part and a lower part, which parts are hinged together and to the bottom by means of hinge mechanisms for folding the container from an unfolded position to a collapsed position and for, conversely, unfolding the container from a collapsed position, said roof and said upper part being immovably fixed relative to each other, defining a space in which the end walls are present in the collapsed position.

Such a freight container is known from GB-2214903. The end walls of the known container are configured as a garage door, which must be completely opened in order to gain access to the container, for example for loading and/or unloading the container. In said open position of the end wall, the roof of the container is supported by the longitudinal side walls and the relatively thick corner beams, which are indicated at 210, 220 and 230 in the figures.

A drawback of the known device is that the end wall must be completely opened in order to gain access to the interior of the container. Another drawback is the fact that the freight container is relatively high in the collapsed position on account of the relatively thick corner beams.

SUMMARY

It is an object of the present invention to provide an improved collapsible freight container.

This object is accomplished with the freight container according to the present invention in that at least one end wall is provided with a casing that supports the roof, in which casing at least one door which can hinge relative to the casing is mounted, which door can hinge from a closed position to an open position, in which open position access to the container is possible for loading or unloading, whilst the casing, with the door in the closed position, is pivotable about a pivot axis from a first position, in which it supports the roof, to a second position within said space, for collapsing the freight container.

By moving the casing that supports the roof into the space for collapsing the container, the relatively thin side walls can be moved one on top of the other, so that the collapsed container will have relatively compact dimensions, more in particular a relatively small height. This has the advantage that more empty collapsed containers can be transported within a specific transport volume, as for example provided by a truck, which eventually means a reduced burden on the environment for the transportation of empty collapsed containers, of course.

Furthermore, because of the door construction the end wall need not be completely moved to the position within the space in order to gain access to the container, so that, for example, the user-friendliness of the freight container according to the present invention is relatively high.

Preferably, the freight containers have standard dimensions, which are generally referred to as TEU or teu. Teu is the standard designation for the dimension of freight containers. One (1) teu equals a freight container having a length of 20 ft (6.06 m). Another standard dimension is a 40 ft freight container. Furthermore, 10 ft containers, in particular used for storage, and 45 ft ("high cube") containers, in particular used for land transport, likewise constitute standard dimensions of freight containers.

One embodiment of the freight container according to the present invention is characterised in that the casing can be locked and unlocked by means of a locking mechanism to be operated externally of the container by an operator, in which locked position the casing is fixed to the bottom, whilst in the unlocked position the casing can pivot about the pivot axis.

In this way unintentional pivoting of the casing, without the casing being actively operated by the operator, is prevented in a simple manner.

Another embodiment of the freight container according to the present invention is characterised in that the casing is connected, via at least one cable, preferably two cables, to an arm positioned on the roof, which arm can be connected to a fork-lift truck or the like.

On the one hand the end wall can be made to pivot from the first position to the second whilst in addition the collapsing of the container can be controlled by means of said cables and the fork-lift truck or crane connected to the arm.

Yet another embodiment of the freight container according to the present invention is characterised in that the freight container is provided with a synchronization mechanism located in said bottom and/or in said space, by means of which the angle between the horizontal and the right-hand lower part and/or the right-hand central part of the longitudinal side wall is maintained substantially equal to the angle between the horizontal and the left-hand lower part and/or the left-hand central part of the longitudinal side wall at any moment during the folding or unfolding of the freight container.

By using such a synchronization mechanism, an even folding and unfolding of the freight container is ensured, resulting inter alia in reduced wear on the freight container upon folding and unfolding.

Another embodiment of the freight container according to the present invention is characterised in that the synchronization mechanism can be locked and unlocked by means of a locking mechanism to be operated externally of the freight container by an operator, in which locked position the container is locked against collapsing from an unfolded position to a collapsed position, and in which unlocked position collapsing of the container from an unfolded position to a collapsed position is possible.

Collapsing of the container will only be possible after the synchronization mechanism has been actively unlocked by an operator. In this way a container which is relatively safe in use is provided.

Yet another embodiment of the freight container according to the present invention is characterised in that the freight container is provided with a trigger mechanism by means of which the collapsing of the freight container can be initiated. The trigger mechanism is preferably provided with a spring mechanism, which, upon being activated, will push against or pull at a part of a longitudinal side wall, causing the freight container to collapse.

When such a trigger mechanism is used, the collapsing of the freight container will take place in a predetermined sequence, which enhances the ease of use for the operators. The trigger mechanism will normally be activated by the casing reaching the second position within the space. The spring mechanism is preferably integrated in a synchronization mechanism, wherein a Bowden cable is operated when the casing reaches the second position within the space, by means of which cable the spring mechanism is operated.

BRIEF DESCRIPTION OF THE DRAWINGS

The invention will now be explained in more detail with reference to a possible embodiment of the freight container according to the invention which is schematically illustrated in the appended figures.

Like parts are indicated by the same numerals in the various figures.

DETAILED DESCRIPTION

Figure 1:
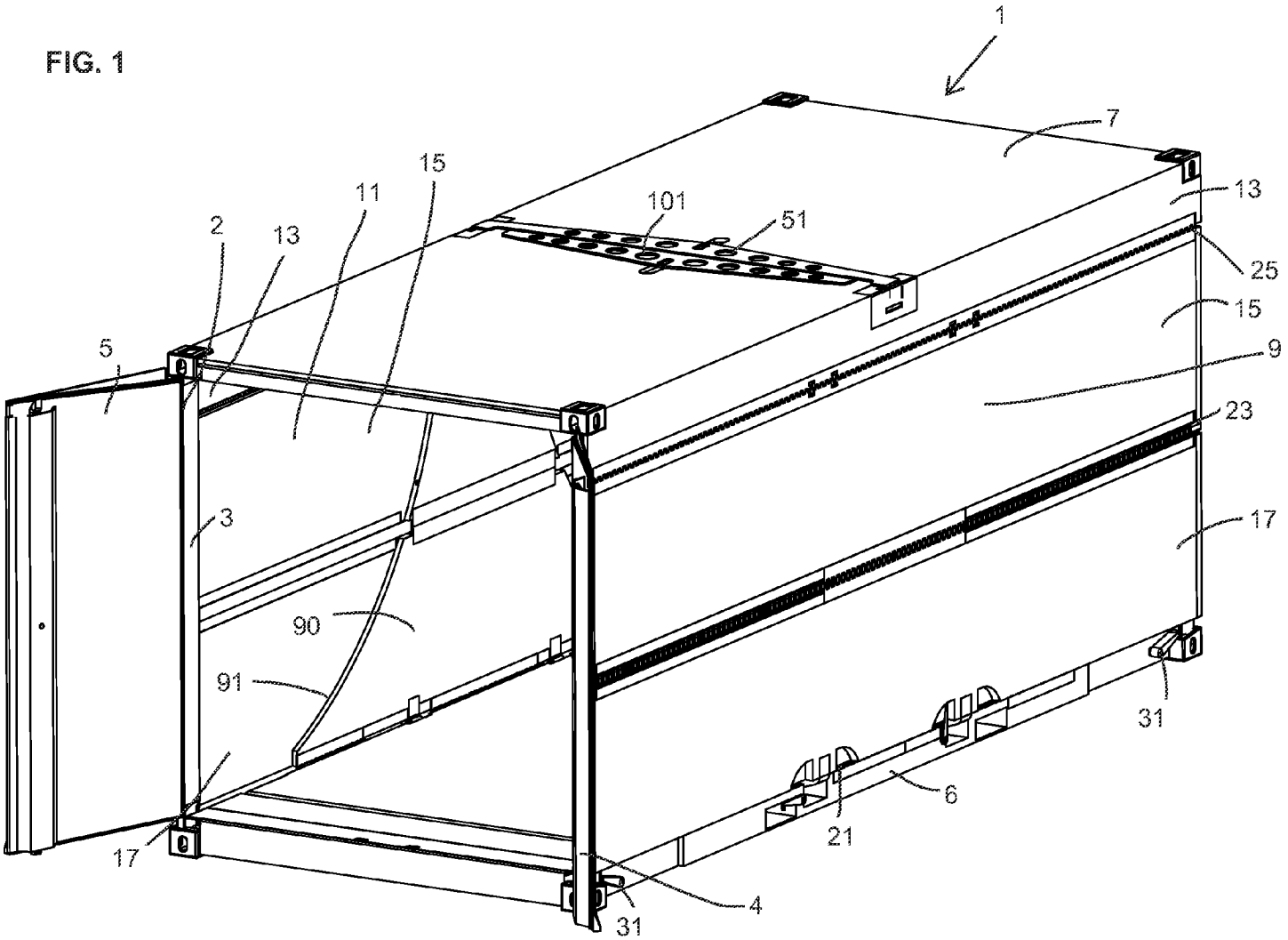
FIG. 1 is a perspective view of an unfolded freight container according to the present invention.

FIGS. 1-4 are perspective views of a freight container 1 according to the present invention, FIG. 1 showing the freight container with an end wall 2 provided with a casing 3 with opened doors 4, 5, so that the contents of the freight container 1, to be referred to below as "container", are accessible. In the illustrated embodiment, the other end wall (not shown) comprises a casing but no doors. It is of course possible to provide this end wall with doors as well.

The collapsible container 1 comprises a bottom 6, a roof 7, the two end walls 2 (only one of which is shown in the figures) extending between the bottom 6 and the roof 7, as well as two longitudinal side walls 9, 11 connected to the bottom 6 and the roof 7. Each longitudinal side wall 9, 11 has an upper part 13, a central part 15 and a lower part 17, which parts are hinged together and to the bottom 6 by means of hinge mechanisms 21, 23, 25 for moving the container 1 from an unfolded position to a collapsed position, and conversely, with the roof 7 and the upper part 13 being immovably fixed, i.e. not being able to hinge, relative to each other, defining a space 30 (see FIGS. 5 and 6) in which the end walls 2 are located in the collapsed position.

The doors 4, 5 can hinge relative to the casing 3 from a closed position to an open position as shown in FIG. 1, in which access to the container is possible for loading or unloading. It is possible to open only one of the two doors 4, 5, for example for an inspection. The use of such doors 4, 5 enhances the ease of use of the container 1.

Figure 3:
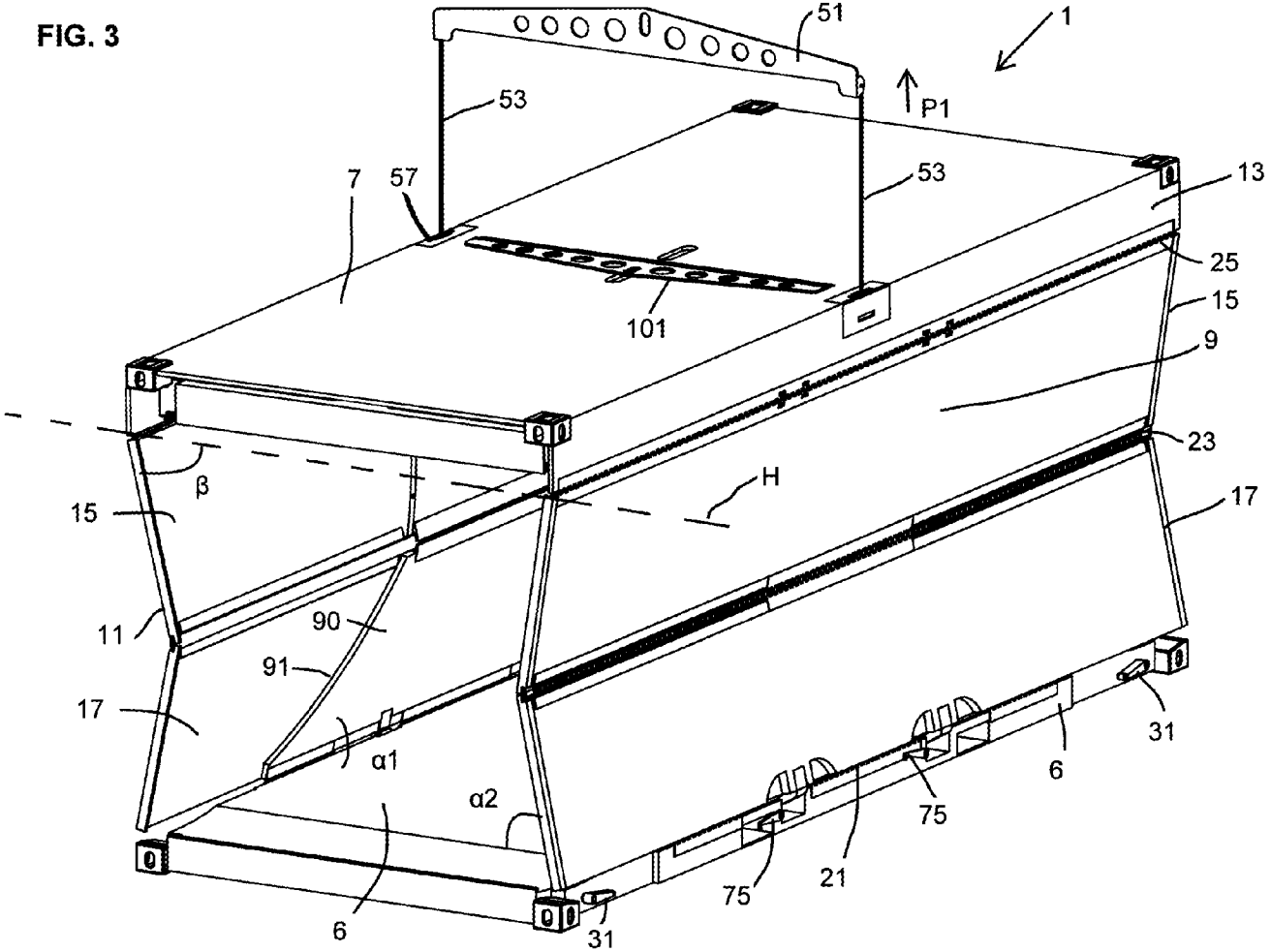
FIG. 3 is a perspective view of a collapsing freight container according to the present invention.
Figure 4:
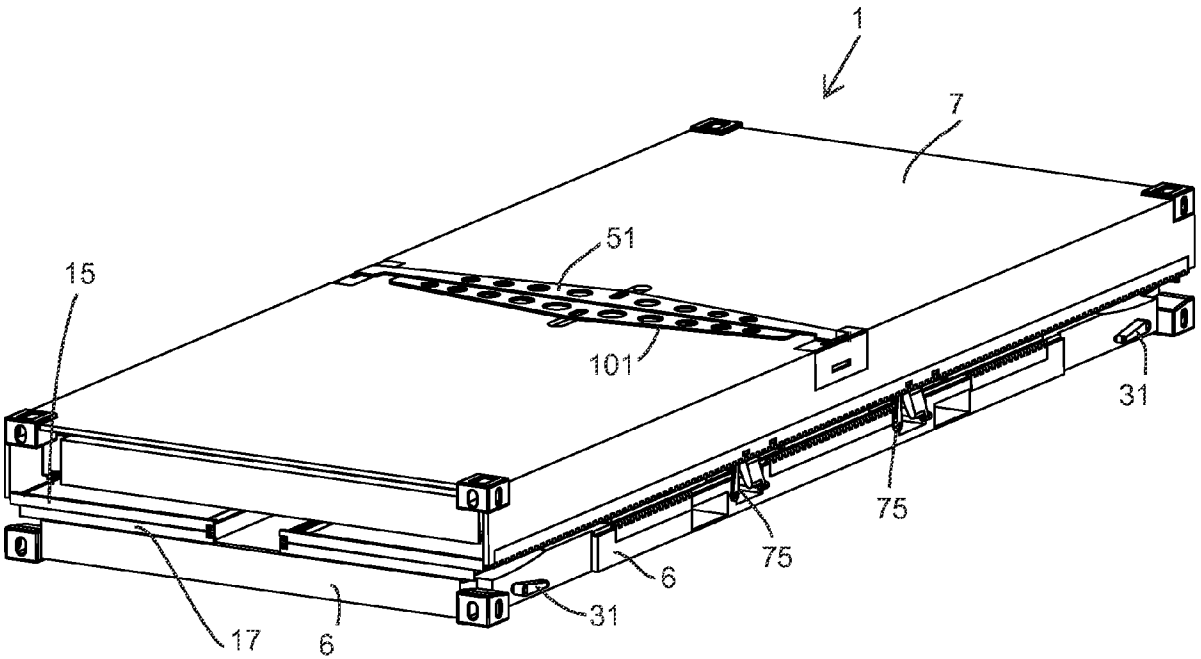
FIG. 4 is a perspective view of a collapsed freight container according to the present invention.

When the container is to be collapsed, the end walls 2 must be pivoted from a first position shown in FIG. 1 to a second position shown in FIGS. 3 and 4.

Figure 7:
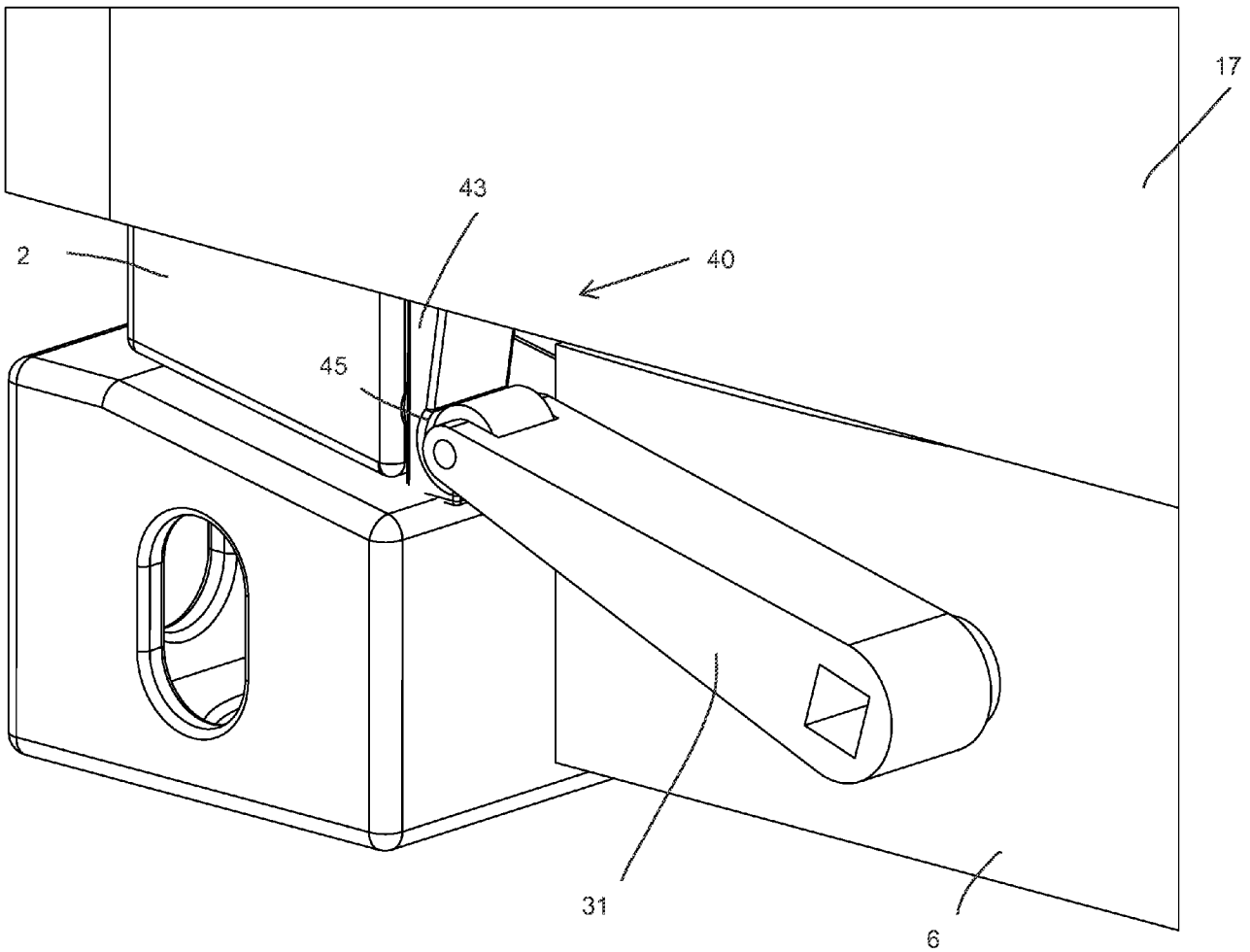
FIG. 7 is a detail view of a part of the freight container according to the present invention.

FIG. 7 shows a detail view of the locking mechanism 40 of the casing 3. The casing 3 itself comprises a support section provided with a recess (not shown) with a spring element (not shown), for example made of rubber, present therein, to which a snap section 43 being pivotally connected to the casing 3 is attached. The snap section 43, which is provided with a recess 45, in combination with the spring element provides a snap mechanism by means of which the casing 3 can be fixed in position with the bottom 6 and the longitudinal side wall 9, 11 by means of the fixing arm 31 of the locking mechanism 40. Using the fixing arm 31, an operator can operate, and thus lock and unlock, the locking mechanism 40 externally of the container, with the casing 3 being fixed to the bottom 6 in the locked position whilst being pivotable about a pivot axis (not shown) in the unlocked position.

Figure 2:
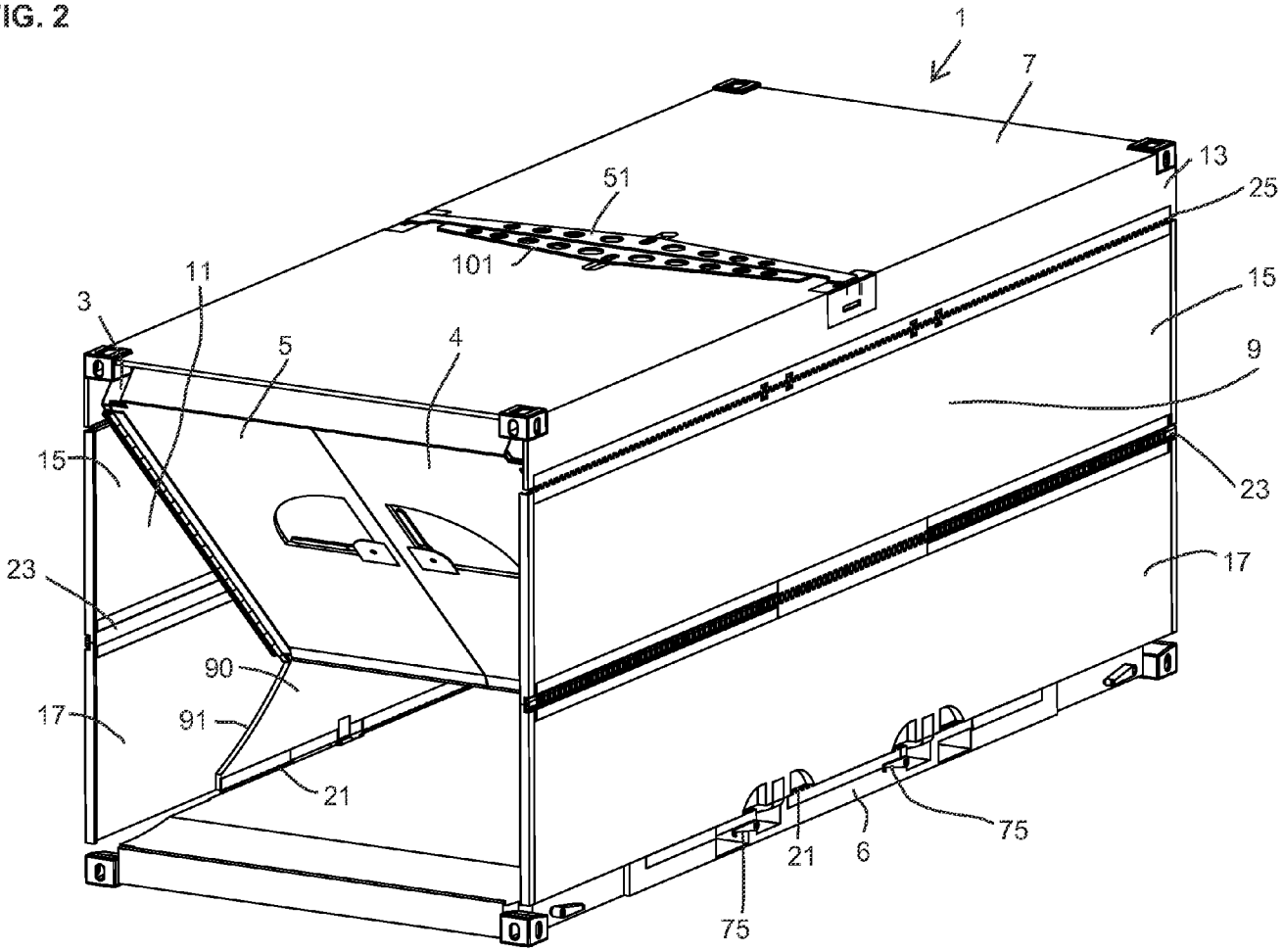
FIG. 2 is a perspective view of a freight container according to the present invention, in which the casing and the doors pivot from a first position shown in FIG. 1 in the direction of the second position.

In FIG. 1 the fixing arm 31 is in the locked position, whilst in FIG. 2 it has been pivoted through 180 degrees to the unlocked position by an operator.

In the unlocked position of the locking mechanism 40, the casing 3 with the doors 4, 5 in the closed position can pivot about a pivot axis (not shown) from a first position, in which it supports the roof (as shown in FIG. 1), to a second position, in which it is located within the space 30 (as for example shown in FIGS. 3 and 4).

Figure 5:
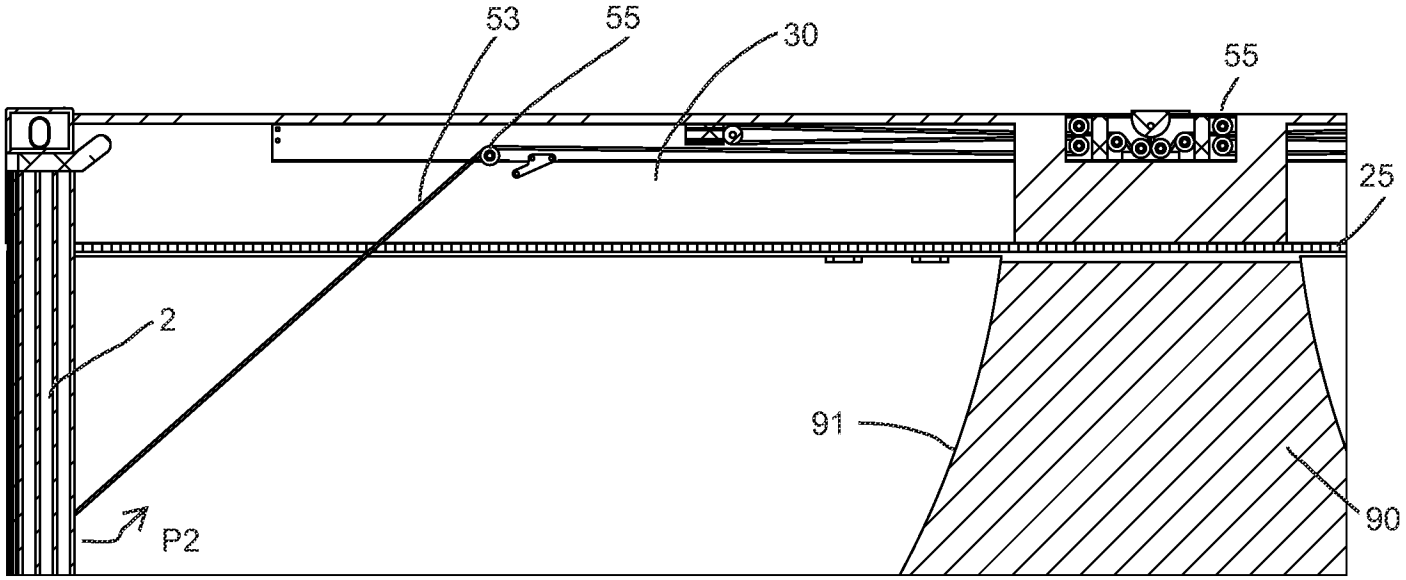
FIG. 5 is a sectional view of a part of the freight container according to the present invention.
Figure 6:
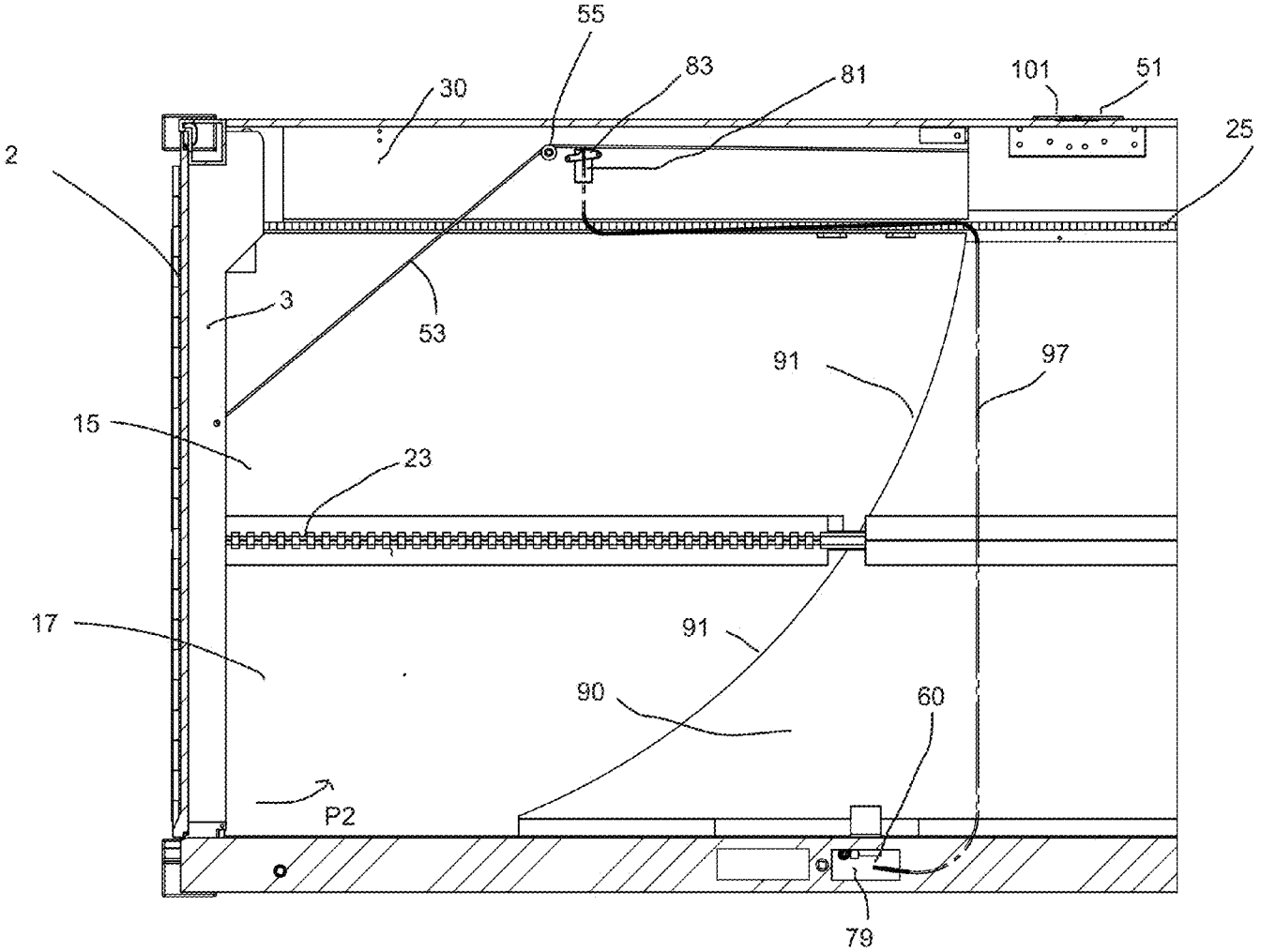
FIG. 6 is a further sectional view of a part of the freight container according to the present invention.

For pivoting the end wall 2, the freight container 1 is provided with an arm 51 disposed on the roof 7 and with two cables 53 connected to the arm. A guide system comprising rollers 55, as shown in FIGS. 5 and 6, guides the cables 53 through the space 30 and along a central part 15 of the longitudinal side wall 9, 11 to the casing 3, to which the cables 53 are attached by fastening means.

When the arm 51 is connected to a hook (not shown) of a lifting mechanism, such as a fork-lift truck or a crane, for example, the arm 51 can be moved up in the direction indicated by the arrow P1 together with the cables (FIG. 3). As a result of being connected to the cables 53, the end wall 2 will pivot in the direction indicated by the arrow P2 (FIGS. 5 and 6) from the first, vertical position shown in FIGS. 5 and 6 to a substantially horizontal position in the space 30 defined by the upper parts 13 of the longitudinal side walls 9, 11 and the roof 7. Practically simultaneously therewith, the other end wall (not shown) will be pivoted by means of cables connected to the arm 51 from a first, vertical position to a substantially horizontal position in the space 30.

Winding mechanisms 57, by means of which the cable 53 can be wound up after it has been pulled up by means of the arm 51, are available in the space 30 for the cable 53 that has been pulled out above the roof 7 of the container 1 as shown in FIG. 3. The winding mechanism 57 may be a spring mechanism, for example, which will not start to pull at the cable 53 until the end wall 2 has reached the second, horizontal position in the space.

Figure 8:
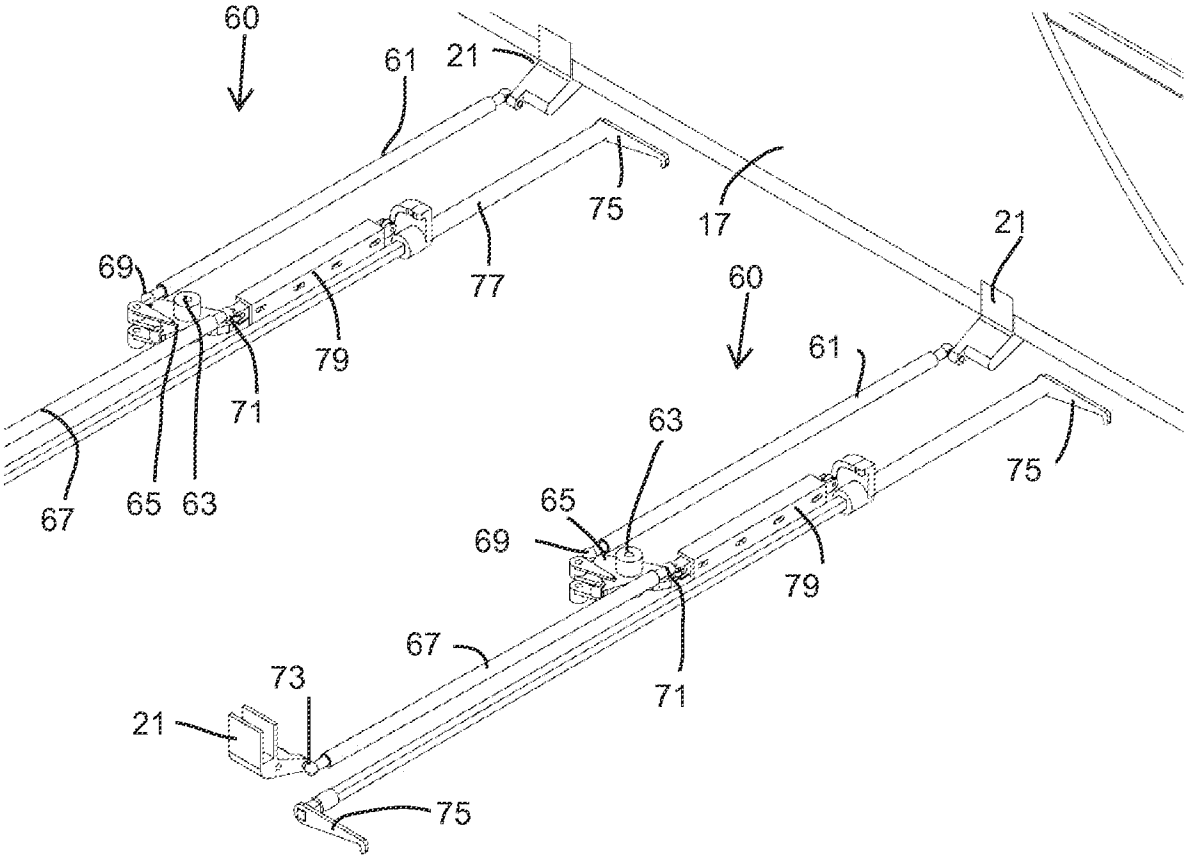
FIG. 8 is a detail view of a synchronization mechanism of the freight container according to the present invention.

The freight container 1 further comprises a synchronization mechanism 60 disposed in the bottom 6 and/or in the space 7. Two embodiments of synchronization mechanisms 60 are shown in FIG. 8, for example. Using the synchronization mechanisms 60, the angle $\alpha_1$ (see FIG. 3) between the bottom 6 and the left-hand lower part 17 and/or the angle $\beta_1$ between the horizontal H (indicated by a dotted line in FIG. 3) and the left-hand central part 15 of the longitudinal side wall 9, 11 is maintained substantially equal to the angle $\alpha_2$ between the bottom 6 and the right-hand lower part 17 and/or the angle $\beta_2$ between the horizontal H (indicated by a dotted line in FIG. 3) and the right-hand central part 15 of the longitudinal side wall 9, 11 at all times. The synchronization mechanisms 60 shown in FIG. 6 are integrated in the bottom 6 of the container 1, and therefore ensure that $\alpha_1$ will equal $\alpha_2$ during the collapsing movement. Each synchronization mechanism 60 comprises at least a first rod 61, which is connected to the hinge mechanism 21 of the lower part 17 of the first longitudinal side wall 9 with one end and with its other end to a plate 65 which is rotatable about an axis of rotation 63, which plate 65 is also connected to at least one end of a second rod 67, the axis of rotation 63 being located approximately centrally between the point of attachment 69 of the first rod 61 to the plate 65 and the point of attachment 71 of the second rod 67 to the plate 65. The second rod 67 is connected to a hinge mechanism 21 of the lower part 17 of the second longitudinal side wall 11 with the other end 73.

The synchronization mechanisms 60 shown in FIG. 6 can be locked and unlocked by means of a locking mechanism, more in particular the locking arm 75, to be operated externally of the container 1 by an operator, the container 1 being blocked against being collapsed in the locked position, whilst collapsing of the container 1 from an unfolded position to a collapsed position is possible in the unlocked position. The rod 77 of each locking mechanism is connected to the plate 65 by means of a spring mechanism 79. The spring mechanism 79 forms part of the trigger mechanism. The trigger mechanism is further provided with a detection means 81 in the form of a pivoted handle 83, which is located in the space 30. When the end wall 2 is in the second position, the end wall 2 will cause the handle 83 to pivot about a pivot axis, whereupon a Bowden cable 97 connected to the spring mechanism 79 will be operated, which Bowden cable will trigger the spring mechanism 79 of the trigger mechanism. When the locking arm 75 is in the unlocked position, the spring mechanism 79 will pull at or push against the plate 65, causing a force to be exerted on the hinges 21 via the rods 61, 67, which force suffices for causing the longitudinal side walls 9, 11, which are still in their upright position, to tilt from the position shown in FIG. 3 to the collapsed position of the container 1 that is shown in FIG. 4. The collapsing process is controlled by means of the fork-lift truck that is connected to the arm 51.

In order to make it possible to unfold the container, the container 1 is provided with a second arm 101 disposed beside the first arm 51 on the roof 7, which second arm 101 is only connected to the roof.

In order to make pivoting of the end walls 2 possible, the longitudinal side walls 9, 11 have a special thickness profile. The fact is that the parts of the longitudinal side walls along which the casing pivots are thinner than the thicker, central section 90. The boundary 91 between the central section 90 and the thin part is represented by the transition 91 in FIGS. 1-3, as well as in FIGS. 5 and 6. Because of the presence of the central section 90, a relatively strong container is obtained, which, in spite of having a minimum weight, is capable of meeting the highest load requirements that are made of freight containers. The freight container according to the present invention is made of light-weight materials such as composite and aluminium, and the maximum weight of a 40 ft freight container is 1800 kg.

The sequence for collapsing and unfolding of the container 1 can be summarized as follows: the arm 51 is connected to a crane or a fork-lift truck, after which an operator unlocks the casing locking mechanism 40, and possibly also the locking mechanism of the synchronization mechanism, by means of locking arms 75. Said locking arms 75 may also be unlocked at a later stage, after pivoting of the end walls 2. By lifting the arm 51 in the direction indicated by the arrow P1, the two end walls 2 will be pivoted from the first, substantially vertical position to the second, substantially horizontal position. When the locking arms 75 are in the unlocked position, the trigger mechanism will initiate the collapsing process, resulting in the collapsing of the longitudinal side walls. If the container 1 is to be moved from the collapsed position shown in FIG. 4 to an unfolded position, a crane or a fork-lift truck is connected to the arm 101 that is connected to the roof, whereupon, when the locking mechanism of the casing and the locking mechanism provided with the locking arms 75 are in the unlocked position, the roof 7 lifted by the fork-lift truck and all the hinged and pivoted parts connected thereto, including the end walls, will be unfolded.

The synchronization mechanism according to the present invention may also be provided in other types of containers, for example in containers in which the longitudinal side walls do not have a central part but only an upper part and a lower part. Such a collapsible freight container comprises a bottom, a roof as well as two longitudinal side walls connected to the bottom and the roof, each longitudinal side wall comprising a first and a second part, which are hinged together in such a manner that the first part can pivot to the second part of the same longitudinal side wall about a pivot axis extending in the longitudinal direction of the freight container, whilst the freight container is further provided with a synchronization mechanism disposed in the bottom and/or in the roof, by means of which the angle between the horizontal and the right-hand lower part and/or the right-hand upper part of the longitudinal side wall is maintained substantially equal to the angle between the horizontal and the left-hand lower part and/or the left-hand upper part of the longitudinal side wall during collapsing and unfolding.

The invention claimed is:

1. A collapsible freight container comprising a bottom, a roof, two end walls extending between the bottom and the roof, as well as two longitudinal side walls connected to said bottom and said roof, each longitudinal side wall comprising an upper part, a central part and a lower part, which parts are hinged together and to the bottom by means of hinge mechanisms for folding the container from an unfolded position to a collapsed position and for, conversely, unfolding the container from a collapsed position, said roof and said upper part being immovably fixed relative to each other, defining a space in which the end walls are present in the collapsed position, characterised in that at least one end wall is provided with a casing that supports the roof, in which casing at least one door which can hinge relative to the casing is mounted, which door can hinge from a closed position to an open position, in which open position access to the container is possible for loading or unloading, whilst the casing, with the door in the closed position, is pivotable about a pivot axis from a first position, in which it supports the roof, to a second position within said space, for collapsing the freight container characterised in that the casing is connected, via at least one cable, to an arm positioned on the roof, which arm can be connected to a fork-lift truck.

2. A freight container according to claim 1, characterised in that the casing can be locked and unlocked by means of a locking mechanism to be operated externally of the container by an operator, in which locked position the casing is fixed to the bottom, whilst in the unlocked position the casing can pivot about the pivot axis.

3. A freight container according to claim 1, characterised in that a winding mechanism (57) is disposed in said space, by means of which winding mechanism the cable can be wound up after it has been pulled out by means of the arm.

4. A freight container according to any one of the preceding claims, characterised in that the freight container is provided with a synchronization mechanism located in said bottom and/or in said space, by means of which the angle between the horizontal and the right-hand lower part and/or the right-hand central part of the longitudinal side wall is maintained substantially equal to the angle between the horizontal and the left-hand lower part and/or the left-hand central part of the longitudinal side wall at any moment during the folding or unfolding of the freight container.

5. A freight container according to claim 4, characterised in that the synchronization mechanism comprises at least a first rod, which is connected to a hinge mechanism of the lower part and/or the central part of the first longitudinal side wall with one end and which is connected with its other end to a plate which is rotatable about an axis of rotation, which plate is also connected to at least one end of a second rod, the axis of rotation being located centrally between the point of attachment of the first rod to the plate and the point of attachment of the second rod to the plate, which second rod is connected to a hinge mechanism of the lower part and/or the central part of the second longitudinal side wall with the other end thereof.

6. A freight container according to claim 4, characterised in that the synchronization mechanism can be locked and unlocked by means of a locking mechanism to be operated externally of the freight container by an operator, in which locked position the container is locked against collapsing from an unfolded position to a collapsed position, and in which unlocked position collapsing of the container from an unfolded position to a collapsed position is possible.

7. A freight container according to claim 1, characterised in that the freight container is provided with a trigger mechanism (79) by means of which the collapsing of the freight container can be initiated.

8. A freight container according to claim 7, characterised in that the trigger mechanism (79) is provided with a spring mechanism, which, upon being activated, will push against or pull at a part of a longitudinal side wall, causing the freight container to collapse.

9. A freight container according to claim 8, characterised in that the trigger mechanism (79) is activated by the casing reaching the second position within the space.

10. A freight container according to claim 8, characterised in that the spring mechanism is integrated in a synchronization mechanism, wherein a Bowden cable is operated when the casing reaches the second position within the space, by means of which cable the spring mechanism is operated.

11. A freight container according to claim 1, characterised in that the parts of the longitudinal side walls along which the casing pivots is thinner than the thicker central section.

* * * * *